US006353187B1

(12) United States Patent
Wilson, Jr.

(10) Patent No.: US 6,353,187 B1
(45) Date of Patent: Mar. 5, 2002

(54) INSULATOR FOR MOUNTING ELECTRIC FENCE CONDUCTORS

(76) Inventor: Robert M. Wilson, Jr., 860 Betterley Rd., Battle Creek, MI (US) 49016

( * ) Notice: Subject to any disclaimer, the term of this patent is extended or adjusted under 35 U.S.C. 154(b) by 0 days.

(21) Appl. No.: 09/620,863

(22) Filed: Jul. 21, 2000

(51) Int. Cl.[7] ..... H01B 17/16

(52) U.S. Cl. ..... 174/158 F; 174/175; 256/10; 256/48; 256/53

(58) Field of Search ..... 174/158 F, 161 F, 174/163 F, 168, 169, 170, 171, 175; 52/244, 300, 301; 248/73; 256/10, 47, 48, 53, 222.12, 222.13; 24/30.5 P

(56) References Cited

U.S. PATENT DOCUMENTS 789,830 A * 5/1905 Zetterlund ..... 174/40 CC
2,311,486 A * 2/1943 Swearingen ..... 174/172
2,340,713 A * 2/1944 Tinnerman ..... 174/40 CC
3,037,729 A * 6/1962 Holton ..... 174/40 CC
4,049,905 A * 9/1977 Maranell ..... 174/163 F
4,263,478 A * 4/1981 Willem ..... 174/169
4,356,599 A * 11/1982 Larson et al. ..... 24/16 PB
4,923,153 A * 5/1990 Matsui et al. ..... 248/74.1
5,032,693 A * 7/1991 Langlie et al. ..... 174/158 F
5,063,274 A * 11/1991 Johnson ..... 174/158 F
5,844,171 A * 12/1998 Fitzgerald ..... 174/92
5,960,522 A * 10/1999 Boe ..... 24/543
5,975,501 A * 11/1999 Berg et al. ..... 256/48

* cited by examiner

*Primary Examiner*—Dean A. Reichard
*Assistant Examiner*—Adolfo Nino
(74) *Attorney, Agent, or Firm*—Gifford, Krass, Groh, Sprinkle, Anderson & Citkowski, P.C.

(57) ABSTRACT

A plastic insulator for holding an electrified conductor, and particularly a conductor of a tape configuration, in insulated relation to a fence post and in elevated position above the ground. The insulator includes a clamping arrangement releasably holding the conductor against axial or radial movement by a pair of conductor engaging members hinged together for movement between a tape receiving and a tape clamping position. The clamping arrangement includes a latch mechanism with a coating finger and a deflectable tab with an opening to receive the finger to prevent relative movement of the conductor engaging members and inadvertent opening of the clamping arrangement.

10 Claims, 1 Drawing Sheet

INSULATOR FOR MOUNTING ELECTRIC FENCE CONDUCTORS

FIELD OF THE INVENTION

This invention relates to electric fence insulators and more particularly to insulators adapted to be used with tape-type electric conductors.

BACKGROUND OF THE INVENTION

The mounting and support of electric fence conductors and particularly the fence conductors of the tape-type requires that the conductors be held securely in position and are not unintentionally dislodged due to strain placed on the conductor by loads placed on the conductor when engaged by animals or other objects. Also it is important that the insulator used to mount the conductor can absorb directional strains when the location of the fence is in areas where there are variations in the terrain so that the loads imposed are not only axially of the conductor but also radially through a full range from horizontal to vertical.

It is an object of the invention to provide an insulator particularly adapted for securing a tape-type electrical conductor so that the mounting arrangement resists relative movement of the conductor both axially and radially.

It is another object of the invention to provide an electric fence insulator adapted to support tape-type conductors to receive and to detachably release an intermediate portion of the conductor.

Still another object of the invention is the provision of an electric fence insulator, which detachably supports an electric conductor in a manner which resists opening movement except from manual manipulation of the latch mechanism.

SUMMARY OF THE INVENTION

The objects of the invention are attained by an insulator for supporting n electric fence conductor on posts of various kinds, which include a body ember with means for mounting the body member to a variety of posts of wood or metal and having various cross-sectional configurations such as rectilinear, T-posts, or round posts. The body member supports a generally V-shaped clamp assembly or mounting structure made up of a pair of legs acting as conductor engaging members connected together at one end for deflection towards each other to engage opposite sides of a tape-type electric fence conductor. The upper end of the legs of the V-shaped member are provided with a latch mechanism that resists both axial and radial movement of the tape and is easily released manually for the purpose of receiving or of removing a conductor.

BRIEF DESCRIPTION OF THE DRAWINGS

The objects of the invention are accomplished by the preferred embodiments disclosed in the following description and illustrated in the drawings in which.

DETAILED DESCRIPTION

The insulator for supporting an electric fence conductor on a fence post is designated generally at 10 and includes mounting means 12 for attaching the insulator 10 to a post 13 and a clamp assembly designated at 14 for holding an electric fence conductor such as a tape conductor. The entire insulator structure 10 is molded as a unit of plastic material.

Figure 1:
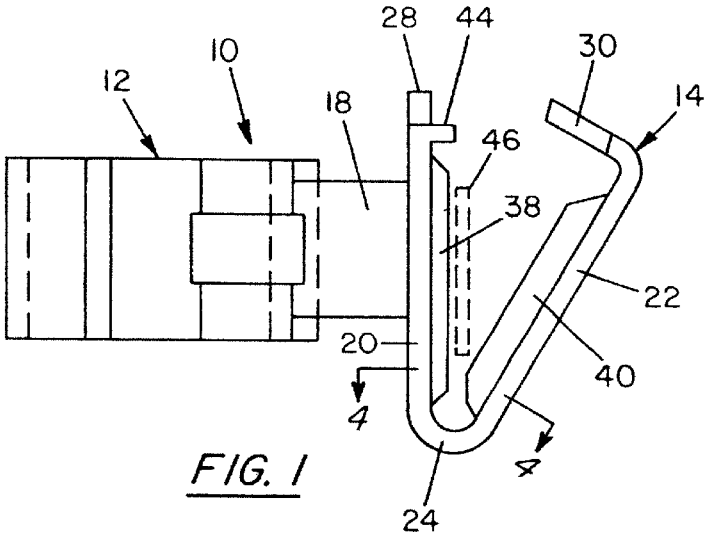
FIG. 1 is a side elevation of an insulator embodying the invention shown in an open position.
Figure 2:
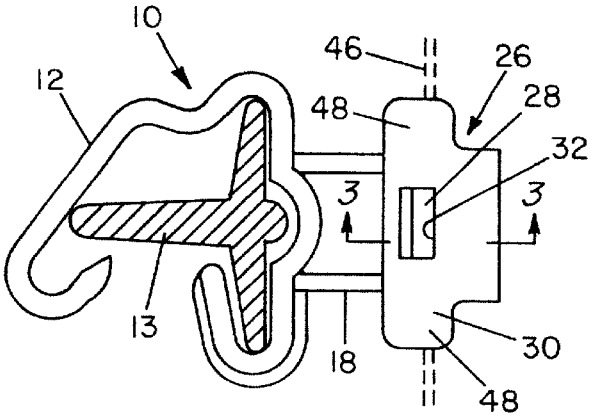
FIG. 2 is a top plan view of the insulator shown in FIG. 1 but in a closed position.

The mounting means 12 can be of a variety of types but the arrangement disclosed in FIGS. 1 and 2 is particularly adapted for use with T-type metal posts. Such mounting means 12 are more fully disclosed in U.S. Pat. No. 4,077,611.

The clamp assembly 14 is formed integrally with the mounting means 12 through a body structure indicated at 18.

As seen in FIG. 1, the clamp assembly 14 is generally V-shaped and includes a pair of elongated conductor engaging members or legs 20 and 22 which are joined together at their lower or first ends by a U-shaped hinge portion 24 formed integrally with the legs 20 and 22. The hinge portion 24 permits flexing of the legs 20 and 22 from an open position as illustrated in FIG. 1 to the closed position illustrated in FIG. 3.

Figure 3:
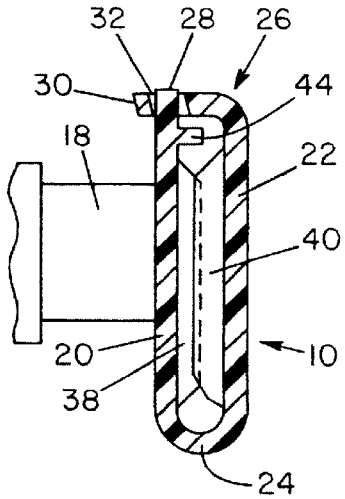
FIG. 3 is a cross-sectional view taken on line 3—3 in FIG. 2 showing a closed condition of operation.

The support bracket or clamp assembly 14 is held in its closed position illustrated in FIG. 3 by a latch mechanism 26. As seen in FIGS. 1 through 3, clamp assembly 14 includes a finger 28, which extends upwardly from the upper or second end of the leg 20. The finger 28 is narrower than the leg 20 and is generally rectilinear in cross-section as seen in FIG. 2.

The corresponding upper or second end of the conductor engaging member or leg 22 is provided with a tab 30 extending toward leg 20 at a right angle from the upper end of the conductor member 22. The tab 30 is provided with a rectilinear opening 32, which, as seen in FIG. 3, is closely spaced from opposite sides of the finger 28 and also from the front and back surfaces, respectively.

Figure 4:
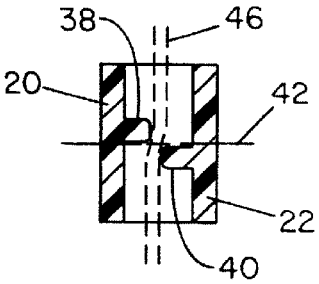
FIG. 4 is a view of a portion of the insulator taken on line 4—4 in FIG. 1.

The conductor engaging members 20 and 22 are each provided with a tape engaging rib 38 and 40, respectively. The ribs 38 and 40 are disposed adjacent opposite sides of a plane indicated at 42 disposed midway of the opposed edges of the legs 20 and 22 as seen in FIG. 4 showing an open condition of the clamp assembly 14. In the closed position, the ribs 38 and 40 will displace the tape further to provide a clamping action.

A ledge 44 is formed at the upper end of the conductor-engaging member 20 immediately above the rib 38 and extends toward the conductor-engaging member 22. As a result, a tape holding seat or space is defined by the ribs 38 and 40 on conductor engaging members 20 and 22 forming the front and back by a hinge portion 24 defining the bottom and by the ledge 44 forming the top.

In use, with the insulator mounted on a fence post in elevated position above the ground, the clamp assembly 14 is placed in its open condition as shown in FIG. 1. This is the as-molded condition, in which the clamp assembly 14 assumes a V-shape to receive a tape-type electric conductor indicated in dash lines at 46-4. With the tape-type conductor 46 positioned in the tape receiving seat of the open support bracket or clamp 14,the conductor engaging members 20 and 22 can be squeezed at their upper ends so that the tab 30 engages the finger 28 and is deflected upwardly to permit the finger 28 to enter the opening 32 after which the tab 30 returns to its as-molded condition relative to leg 22.

As the conductor engaging members 20 and 22 move to their closed position shown in FIG. 3, the ribs 38 and 40 engage opposite sides of the tape surfaces of the conductor 46 and deflect the tape in opposite directions to clamp it to prevent axial movement.

It will be noted that in its closed position as illustrated in FIG. 3, the ledge 44 protects or isolates the tab 30 from engagement by the tape conductor 46 so that any upward sliding movement of the tape is limited and engagement with the tab 30 is prevented to avoid any unintentional disengagement of the latch mechanism.

To facilitate release the clamp assembly 14 for insertion or removal of the tape conductor 46, the tab 30 is provided with oppositely extending gripping extensions or surfaces 48 best seen in FIG. 2. To open the clamp assembly 14, the fingers of one hand can be placed under the gripping surfaces 48 of the tab 30 to deflect the tab 30 upwardly to disengage the latch finger 28 from the opening 32 and at the same time pull the leg 22 away from the leg 20 and fence post. The conductor engaging members or legs 20 and 22 will tend to move to and remain in their open position seen in FIG. 1 due to the as-molded characteristics of the plastic material forming the clamp assembly 14.

Figure 5:
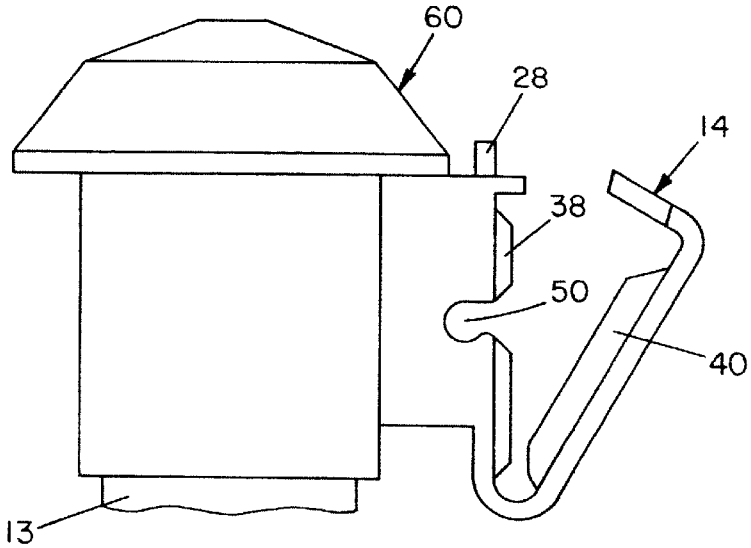
FIG. 5 is a side elevation of another embodiment of the invention.

The tape supporting clamp assembly 14 can be provided with a variety of arrangements other than the mounting means 12 for securing the clamp assembly 14 to other forms of fence posts made of wood or metal and having a variety of cross-sections such as rectilinear or round. By way of example, another embodiment of the invention is shown in FIG. 5. In this embodiment of the invention, an insulator 60 is intended to be supported on the top of a post 13. The clamp assembly 14 is identical to that of the embodiment of the invention shown in FIGS. 1 through 4 except that it is provided with a separate recess indicated at 50 to receive an electric conductor having a round cross-section. The recess 50 extends transversely to the rib 38 intermediate its ends. When a conductor with a round cross-section is placed in recess 50 and the clamp assembly 14 is placed in its closed position and the rib 40 firmly presses the elongated conductor against the backside of the recess 50.

An electric fence insulator, particularly adapted for holding tape-type insulators but capable of use with other types of conductors has been provided in which the conductor is firmly secured against both axial and radial movement by a clamping action resulting from moving the conductor engaging members of a clamp assembly into engagement with opposite sides of the conductor. Also, the latch mechanism holding the clamp assembly in its closed position is such that a latch finger is confined in a manner to prevent deflection of the legs of the clamp assembly in all directions to avoid accidental opening and release the conductor.

I claim:

1. A plastic insulator for supporting an electric fence conductor on a post comprising:

a body member;

mounting means for attaching said body member to a fence post; a pair of elongated conductor-engaging members, one of said conductor-engaging members being supported by said body member;

a hinge mechanism connecting a first end of each of said conductor-engaging members to each other for movement between opened and closed positions in which said conductor engaging members are parallel to each other to form a conductor-receiving seat and an open position in which said conductor-engaging members diverge from each other and form a conductor-receiving opening between second ends of each of said conductor-engaging members;

a finger member extending from one of said second ends of said conductor-engaging members;

a tab extending from the other of said second ends and being deflectable relative thereto, said tab forming an opening to receive said finger to hold said conductor-engaging members in said closed position, said tab being deflectable manually to release said finger and permit movement of said conductor-engaging member to said open position for placement of a conductor in said seat; and a ledge formed on one of said conductor-engaging members above said conductor receiving seat to limit upward displacement of a conductor in said seat.

2. The plastic insulator of claim 1 and further comprising rib members extending longitudinally on each of said conductor engaging members for engaging opposite sides of an electric conductor.

3. The plastic insulator of claim 1 wherein one of said ribs forms a recess to receive an electrical conductor having a round cross-section.

4. The plastic insulator of claim 3 wherein the other of said ribs engages said conductor and closes said recess.

5. The plastic insulator of claim 1 wherein said tab has gripping portions extending to opposite sides of said opening in said tab member.

6. The plastic insulator of claim 1 wherein said opening surrounds said finger to limit the deflection of said second ends of said other of said conductor-engaging members in all radial directions from said finger.

7. An insulator for supporting an electrified fence conductor relative to a fence post comprising:

a body member;

means for attaching said body member to a fence post;

a pair of elongated conductor-engaging members each having a first end hingedly connected together for movement between a closed position generally parallel to each other and forming a conductor-receiving position therebetween and an open position in which said conductor-receiving members diverge from each other to form an opening to receive an intermediate portion of an electric conductor between said conductor-engaging members, said conductor-engaging members being attached to said body member;

a latch mechanism including a finger at a second end of one of said conductor engaging members;

a tab member at a second end of the other of said conductor-engaging members, said tab member being deflectable relative to said other of said conductor-engaging members, said tab member forming an opening to receive said finger when said conductor-engaging members are in said closed position to secure said conductor-engaging members against opening movement relative to each other, said tab member being deflectable to release said finger from said opening for movement of said conductor-engaging members to said open position; and a ledge formed to extend from one of said conductor-engaging members above said conductor receiving position to form a barrier to upward movement of a conductor when said conductor-engaging members are in their closed position.

8. The insulator of claim 7 wherein said elongated conductor engaging members each have longitudinally extending ribs for engagement with opposed side surfaces of an electrical conductor.

9. The insulator of claim 8 wherein one of said ribs forms a recess for receiving a round conductor and the other of said ribs engages said conductor to hold the latter in said recess when said conductor engaging members are in said closed position.

10. The insulator of claim 7 wherein said ribs are each disposed at opposite sides of a place between opposed side edges of said conductor engaging members.

* * * * *